United States Patent [19]

Schmidt et al.

[11] Patent Number: 4,599,518

[45] Date of Patent: Jul. 8, 1986

[54] TRANSPORT AND STORAGE CONTAINER ASSEMBLY FOR LOW AND MEDIUM LEVEL RADIOACTIVE WASTE AND METHOD OF FILLING THE SAME

[75] Inventors: Werner Schmidt; Bernd D. Hahn, both of Springe, Fed. Rep. of Germany

[73] Assignee: Deutsche Gesellschaft für Wiederaufarbeitung von Kernbrennstoffen mbH, Hanover, Fed. Rep. of Germany

[21] Appl. No.: 626,638

[22] Filed: Jul. 2, 1984

[30] Foreign Application Priority Data

Jul. 6, 1983 [DE] Fed. Rep. of Germany ..... 3324293

[51] Int. Cl.[4] ..... G21F 5/00; G21F 9/36

[52] U.S. Cl. ..... 250/507.1; 252/633

[58] Field of Search ..... 250/506.1, 507.1; 252/633

[56] References Cited

U.S. PATENT DOCUMENTS 4,016,096 4/1977 Meyer ..... 250/507.1

4,414,475 11/1983 Kratz et al. ..... 250/507.1

FOREIGN PATENT DOCUMENTS 0482265 1/1970 Switzerland ..... 250/506.1

*Primary Examiner*—Bruce C. Anderson

*Assistant Examiner*—Jack I. Berman

*Attorney, Agent, or Firm*—Walter Ottesen

[57] ABSTRACT

A transport and storage container for low and medium level radioactive waste is sealed with an external cover after being charged with a receptacle insert. The receptacle insert has a cup-like configuration and is arranged in the storage container and adapted directly to receive the radioactive waste. The storage vessel and the receptacle insert conjointly define an annular space therebetween. The storage container must be appropriate for remotely-controlled handling and must have the greatest possible capacity per drum. For this purpose the top of the receptacle insert has a radially extending centering ring at the edge of its opening with segment-like recesses disposed in spaced relationship to each other around its periphery. The wall of the insert tapers downwardly toward the base thereof. A supporting ring extends around the outer periphery and is arranged on the external surface of the insert in spaced relationship to the centering ring and its outer diameter is greater than the inner diameter of the centering ring. The invention is also directed to a method of charging such a container for low and medium level radioactive waste.

14 Claims, 9 Drawing Figures

TRANSPORT AND STORAGE CONTAINER ASSEMBLY FOR LOW AND MEDIUM LEVEL RADIOACTIVE WASTE AND METHOD OF FILLING THE SAME

FIELD OF THE INVENTION

The invention relates to a transport and storage container assembly for low and medium level radioactive waste. The container includes a vessel having an opening through which the vessel is charged and a cover for closing the vessel. A cup-shaped receptacle insert is arranged in the storage container and is adapted to directly receive the radioactive waste. The cup-shaped receptacle and the vessel of the container conjointly define an annular gap therebetween when the receptacle is seated in the vessel.

BACKGROUND OF THE INVENTION

Containers are normally used for transporting and storing low and medium level radioactive substances. The radioactive substances held in the containers may be either untreated or solidified substances intended for ultimate storage. Solidification may be effected, for example, by cementing or bituminizing.

When a receptacle is filled with radioactive substances in a shielded cell, there is a danger of the outside of the receptacle becoming contaminated. Accordingly, the outside surface of the receptacle has to be decontaminated before it can be handled further. However, decontamination leads to secondary waste. The availability of the filling device is reduced by the decontaminating process. In addition, decontamination is a complicated step, particularly when dealing with medium level radioactive materials, since the operations can only be carried out by remote control because of the high radiation.

It would therefore be advantageous for the radioactive materials intended for transportation and disposal to be first placed in a separate receptacle insert in the shielded cell. The receptacle insert, which may be contaminated on the outer surface, would then be passed through a double-cover transfer lock into the storage container standing ready in a non-active cell.

The use of the receptacle insert must allow for remote-controlled handling in the confined space of the shielded cell without the capacity of the receptacle insert being reduced by handling aids.

SUMMARY OF THE INVENTION

It is an object of the invention to provide a transport and storage container assembly of the type described above for which the remote-controlled handling during the process of charging the container is simplified and the greatest possible capacity per container is utilized.

The above object is achieved with the transport and storage container assembly of the invention for weak and medium radioactive waste. The assembly includes a cup-shaped receptacle insert for receiving the radioactive waste directly therein and a vessel for receiving the receptacle insert therein. The vessel and the insert conjointly define an annular space between the inner wall surface of the vessel and the outer wall surface of the insert when the latter is seated in the vessel. The vessel has an upper end portion defining an opening through which the receptacle insert is passed when placed in the vessel. A cover is provided for closing the opening of the vessel after the receptacle has been placed therein.

The receptacle insert has a rim at its upper end defining the opening thereof through which the radioactive waste to be held therein is passed. The receptacle insert includes a manipulating ring mounted to the rim and extending in a radial direction therefrom. The manipulating ring includes engaging means formed therein for facilitating engagement by a manipulating tool whereby the receptacle insert can be placed in said vessel. The receptacle insert has a bearing ring mounted on the wall thereof beneath and in spaced relationship to the manipulating ring.

According to a feature of the invention, the receptacle insert may be kept stacked in the shielded work location and can be firmly grasped by lifting mechanisms. The receptacle insert can be inserted in the vessel by a lifting mechanism engaging the engaging means which can be in the form of recesses.

The bearing ring on the outer or inner surface of the receptacle insert acts as a support during stacking. The external support ring rests on the manipulating ring of the receptacle insert disposed therebeneath. The slight conical shape of the insert permits stacking of the inserts. The distance between the support ring and the manipulating ring is such that, when the empty inserts are placed inside one another for compact storage, jamming of the conical surfaces is avoided.

According to another feature of the invention, the manipulating ring is mounted to the rim of the receptacle insert so as to extend outwardly therefrom for coacting with the upper end portion of the vessel to center the insert in the vessel when the insert is placed therein.

The manipulating ring is also a centering ring and lies with its upper periphery against the inner surface of the container vessel and so ensures that there is a uniform annular space between the container vessel and the receptacle insert. The annular space can be filled through the recesses with a cast material for imparting strength and/or for shielding purposes.

The method of the invention is directed to filling a transport and storage container assembly of the type described above.

The method of the invention is applicable to a shielded cell equipped with remotely-controlled manipulating means and having double-cover lock means arranged in the floor wall of the cell for separating the interior of the cell from the ambient and for detachably holding the cover of the container. The method includes the steps of: providing a stack of the receptacle inserts in the shielded cell; taking the top receptacle insert from the stack utilizing the remotely-controlled manipulating means and bringing the same to a filling location; filling the receptacle insert with radioactive waste; bringing the filled receptacle insert to a position above the double-cover lock means; connecting the vessel to the double-cover lock means at the lower side thereof in the ambient and beneath the floor wall; opening the double-cover lock means; lowering the receptacle insert through the double-cover lock means into the vessel; removing the manipulating means and then closing the double-cover lock means; and, closing the vessel with the cover mounted in the double-cover lock means.

With a handling method of this type, only the insert is contaminated on the outside. The storage container which receives the receptacle insert can be transported and stored immediately after it has been filled. Special efforts at decontamination are not necessary.

BRIEF DESCRIPTION OF THE DRAWING

The invention will now be described with reference to the drawing wherein.

DESCRIPTION OF THE PREFERRED EMBODIMENTS OF THE INVENTION

Figure 1:
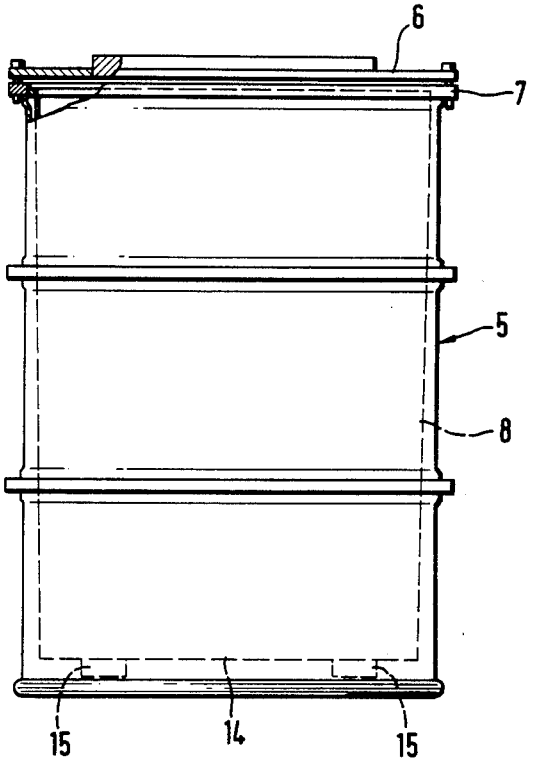
FIG. 1 is a side elevation view, partially in section, of a container including a vessel in the form of a rolling hoop drum holding a receptacle insert therein and a cover which is bolted on the drum.

The storage container 5 shown in FIG. 1 is a commercially available 400 liter rolling-hoop drum which is sealed by a cover 6. The cover 6 is screwed to a mounting flange 7 mounted on the outside of the drum 5. The phantom outline depicts the arrangement of a receptacle insert 8 in the container 5. The receptacle insert 8 has a downwardly tapering cross-section and has an externally conical cup-like configuration.

Figure 2:
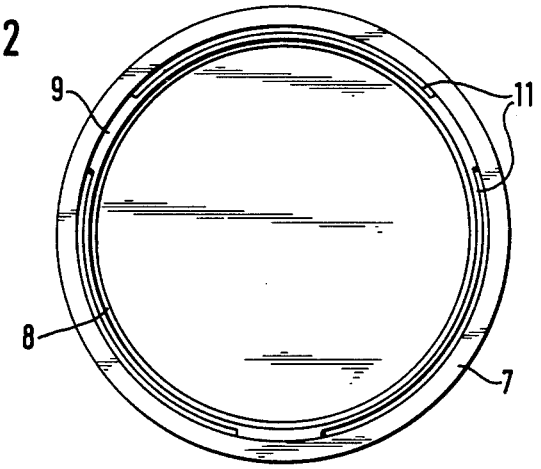
FIG. 2 is a plan view of the container of FIG. 1 with the cover omitted.
Figure 3:
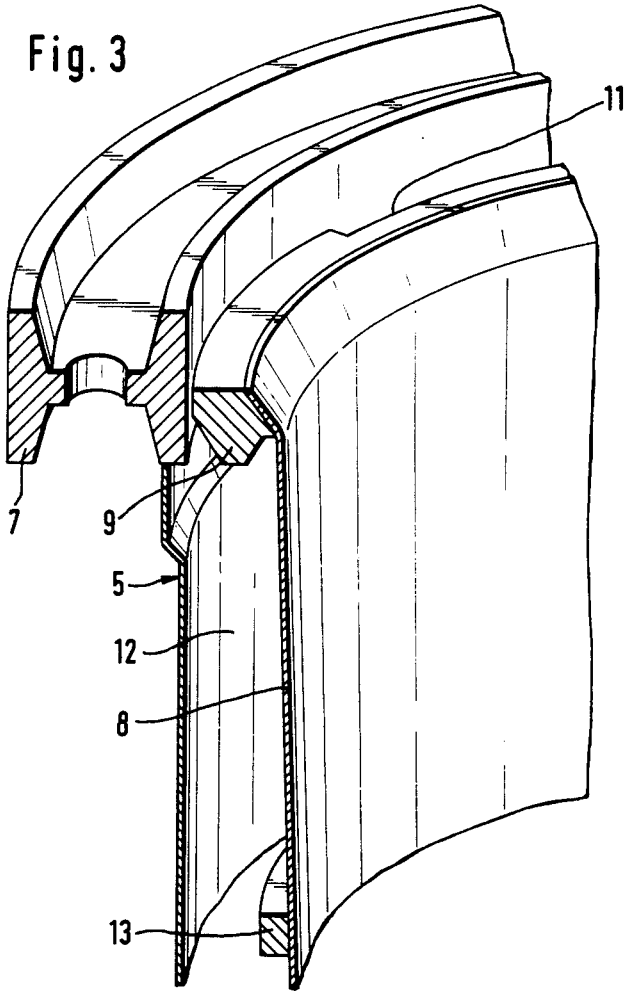
FIG. 3 is a fragmentary view, partially in section, of the drum and the receptacle insert placed therein.

A centering manipulating ring 9 is welded to the outside of the upper edge defining the opening of the receptacle insert 8 (FIGS. 2 and 3). The outer diameter of the ring 9 is only slightly less than the inner diameter of the inner wall of the drum 5 in contact therewith. The inner wall is defined in the upper region thereof by the mounting flange 7.

The centering ring 9 has several segmental recesses 11 formed therein at the outer periphery thereof. These recesses communicate with an annular space 12 located between the external surface of the receptacle insert 8 and the internal surface of the drum 5. The downwardly and inwardly chamfered cross-sectional profile of the ring 9 makes it easier to place the insert 8 in the drum 5.

On the top third of the receptacle insert 8, a bearing or supporting ring 13 extends around and is welded to the external surface of the insert 8; the outer diameter of the bearing ring 13 is greater than the inner diameter of the centering ring 9.

Referring again to FIG. 1, the base 14 of the receptacle insert 8 is provided externally with spacing members 15 which act as feet.

Figure 5:
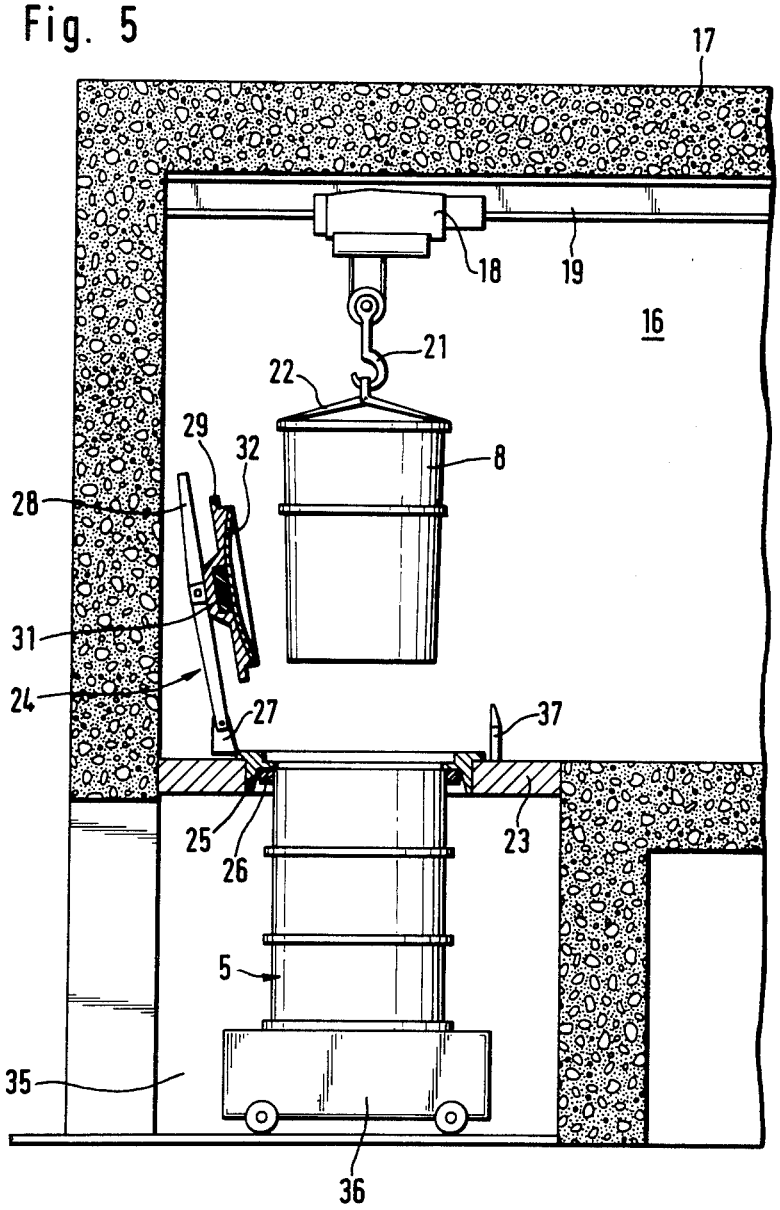
FIG. 5 illustrates the process of charging a transport and storage drum disposed outside of a shielded cell with a receptacle insert still within the cell and about to be passed through the transfer lock.

The process of charging the storage container 5 with the receptacle insert 8 is illustrated in FIG. 5. In a shielded and contaminated cell 16, a crane 18 is adapted to travel along crane rails 19 under the ceiling 17 of the cell. A grab yoke 22 is suspended from the crane hook 21 of the crane 18 and engages in the segmental recesses 11 of the receptacle insert 8. FIG. 5 shows the insert 8 being held over an open transfer lock 24 having two covers arranged in the base 23 of the cell 16. Transfer locks with two covers have long been known in nuclear technology and are used in transfer of articles from one chamber to another where one of the two chambers is radioactive.

The configuration of the transfer lock illustrated diagrammatically in FIG. 5 includes a lining 25 which is inserted in the opening formed in the bottom of the cell and which has an annular sealing surface 26 in a recess formed at the underside thereof. At the outer periphery of the lining 25, a lever 28 is connected to a lining bracket 27 in the contaminated cell 16 and carries a sealing bell 29. A permanent magnet 31 is set into the center of the sealing bell. In the position of the double-cover transfer lock illustrated, the permanent magnet 29 keeps an internal cover 32 pressed firmly against the inside of the covering bell 29. The internal cover 32 can therefore not be contaminated on the surface facing towards the sealing bell.

Below the opening in the bottom wall 23 of the cell 16, a truck 36 is positioned in a non-contaminated, freely accessible cell 35. The truck 36 carries the container 5 and presses the drum against the sealing surface 26 of the lining 25 of the transfer lock from below. A locking hook for the sealing bell 29 is shown at 37.

The apparatus described above is manipulated and operates as follows.

Figure 4:
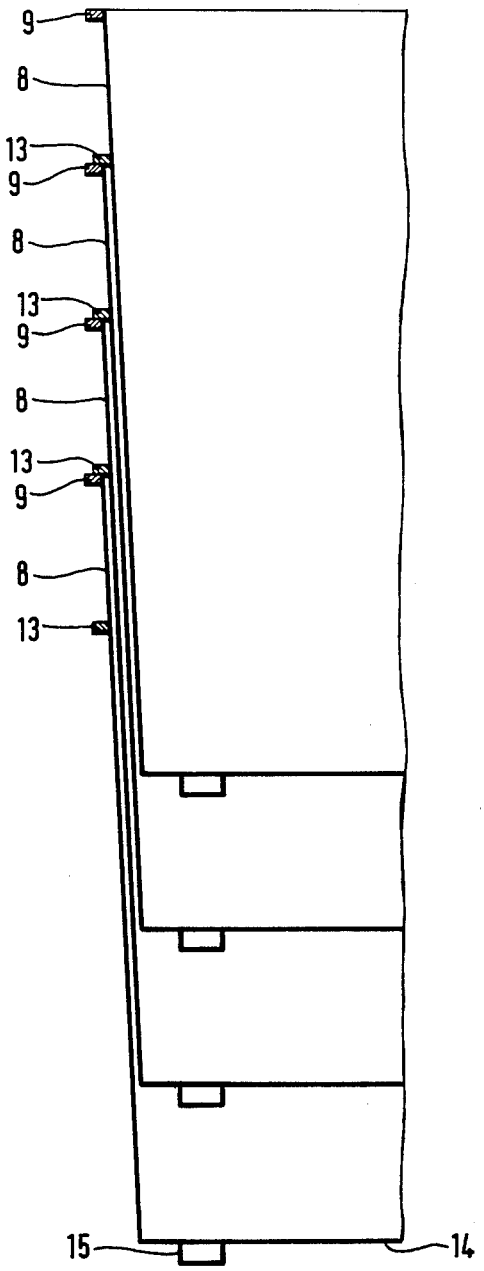
FIG. 4 is an elevation view of stacked receptacle inserts.

The receptacle inserts 8 can be stacked as shown in FIG. 4 and are provided in stacked form in the shielded cell in which the process of filling the insert is carried out.

The uppermost receptacle insert is lifted out of the stack and taken to the filling location by a hoist 18 provided with a grab yoke 22. The segment-like recesses 11 enable the grab yoke 22 to be applied outside the cross-section of the insert 8 through which the latter is filled. The opening through which the insert is filled is thus completely free so that also larger contaminated or radioactive articles can be placed inside the insert 8.

When the receptacle insert 8 has been filled, the hoist 18 lowers it through the base wall 23 of the shielded cell 16 (FIG. 5) via the two-cover transfer lock 24 arranged in an opening of the base wall and into storage container 5 positioned below the base wall 23. The grab yoke 22 engages the centering ring 9 in the segmental recesses 11 so that insertion into the container vessel 5 is not impeded.

When the receptacle insert 8 has been placed in the storage vessel and the hoist 18, 21, 22 raised, the container 5 is sealed with cover 32 in a known manner by means of the two-cover system 24. After it is moved away from the transfer lock 24, the storage container is provided with the second, outer cover 6.

Figure 6:
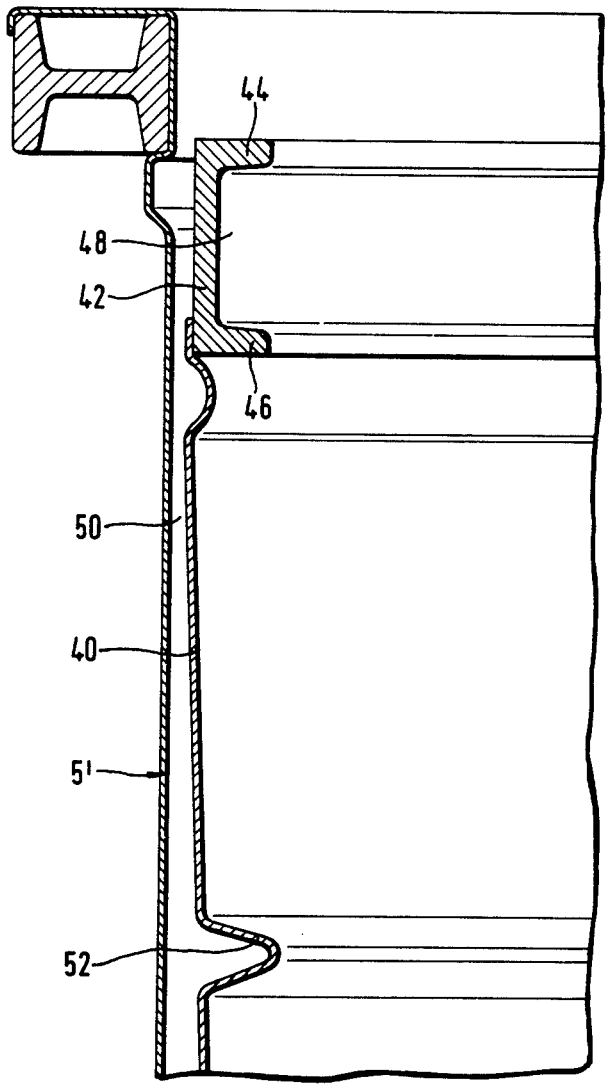
FIG. 6 is a fragmentary enlarged view of a container vessel and receptacle insert placed therein according to an alternate embodiment of the invention.

FIG. 6 is an alternate embodiment of the invention wherein the receptacle insert 40 is provided with a steel ring 42 having a U-shaped cross-section and welded onto the upper open end thereof. The two legs 44 and 46 of the ring 42 are horizontal. The ends of the legs 44 and 46 are directed inwardly towards the center of the ring thereby defining a receiving recess 48 which can be accessed from inside the ring 42. The outer diameter of the insert 40 and ring 42 is only slightly less than the inner diameter of the storage vessel 5'. There is therefore only an extremely small annular gap 50 between the vessel 5' and the insert 40 so that the insert 40 exerts a self-centering action when it is lowered into the vessel 5'.

The receptacle insert 40 is provided in the top third thereof with an inwardly extending bead 52 which extends around the inner periphery of the insert 40 and acts as a bearing ring. The inner diameter of bead 52 is less than that of the steel ring 42.

Figure 7:
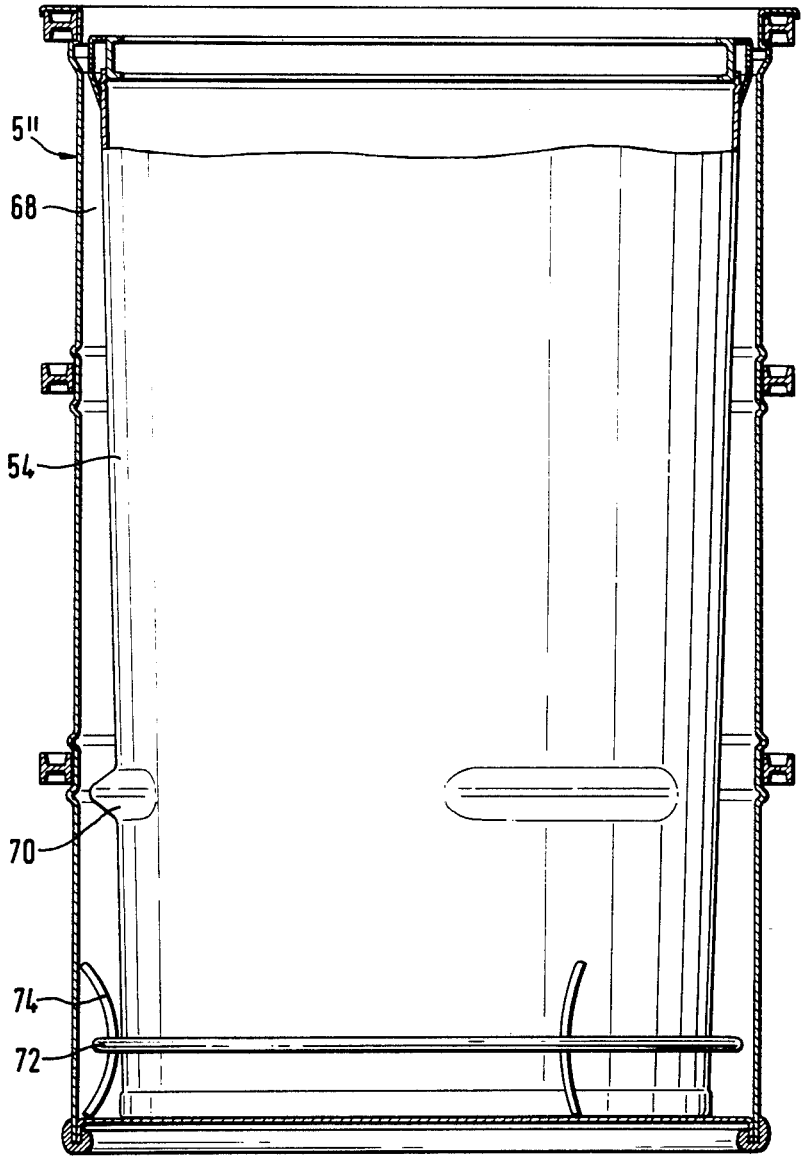
FIG. 7 shows a rolling hoop drum with a receptacle insert placed therein according to a third embodiment of the invention.
Figure 8:
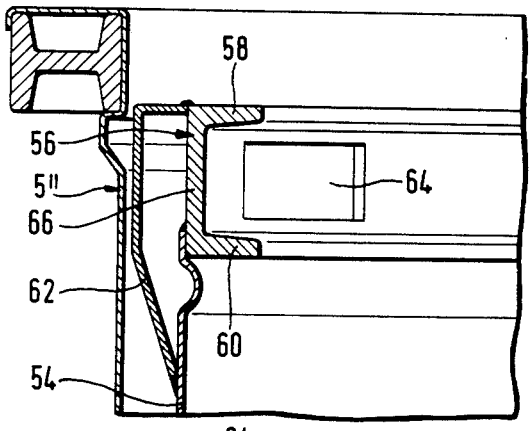
FIG. 8 is an enlarged fragmentary view of the storage drum and receptacle insert of FIG. 7; and, FIG. 9 is a plan view of the drum of FIG. 7 with the cover omitted.
Figure 9:
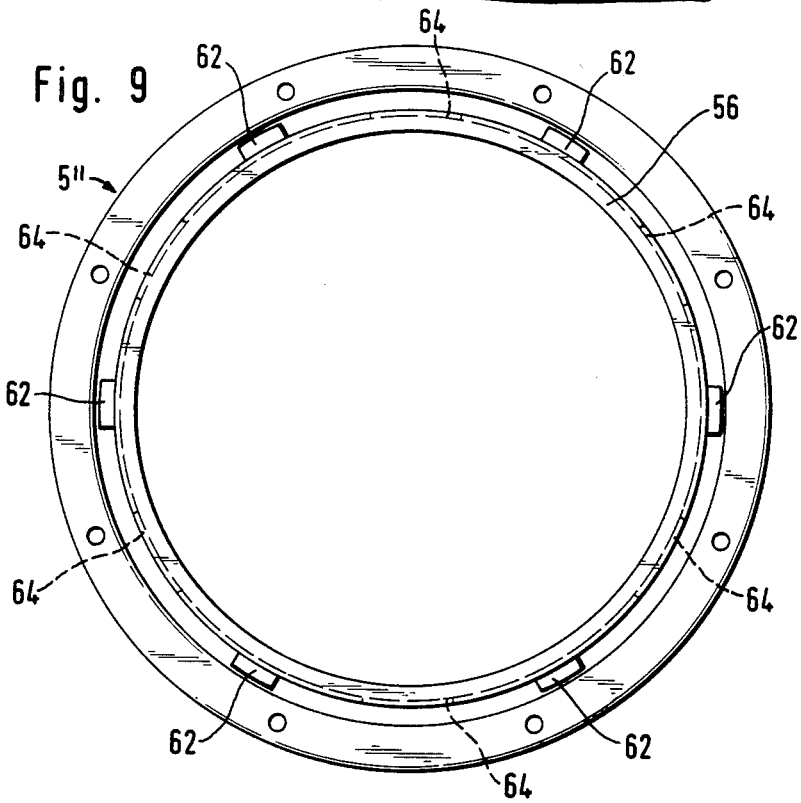

FIGS. 7 to 9 illustrate still another embodiment of a receptacle insert 54. The receptacle insert 54 again has a steel ring 56 of U-shaped cross-section welded onto its open end with inwardly directed horizontal legs 58 and 60. Six centering plates 62 are disposed in uniform spaced relationship one next to the other about the outer periphery of the receptacle insert 54 at the upper end thereof. The bent upper end of each plate 62 is welded to the ring 56 and the lower end to the external surface of the receptacle insert 54. The ring 56 contains six openings 64 which are formed in the web 66 thereof and offset from the centering plates 62 (FIG. 9). The centering plates 62 cause the receptacle insert 54 to be placed centrally in the storage vessel 5''.

Referring to FIG. 7, the free annular gap 68 between the storage vessel 5'' and the receptacle insert 54 remains constant about the periphery of the latter. Subsequent filling of the gap 68 is therefore quite feasible.

As shown in FIG. 7, the receptacle insert 54 has three segment-like beads 70 evenly distributed on the outer surface thereof in a cross-sectional horizontal plane at an elevation one-third up from the base of the insert. The beads 70 project outwardly and act as a bearing for a stacked arrangement of the receptacle inserts 54.

In a lower region of the receptacle insert 54, a guide ring 72 in the form of a thin-walled tube is fixedly attached to the outer surface of the insert and lies in the horizontal cross-sectional plane. The guide ring 72 carries three spacers 74, which are evenly distributed around the periphery and provide additional assistance in centering the insert 54.

It is understood that the foregoing description is that of the preferred embodiments of the invention and that various changes and modifications may be made thereto without departing from the spirit and scope of the invention as defined in the appended claims.

What is claimed is:

1. A transport and storage container assembly for weak and medium radioactive waste comprising:

a cup-shaped receptacle insert for receiving the radioactive waste directly therein;

a vessel defining a longitudinal axis and having an opening at its upper end for receiving said receptacle insert therein when the latter is lowered into the same along said axis;

a cover for closing said opening of said vessel after said receptacle has been placed therein;

said receptacle insert having a rim at its upper end defining the opening thereof through which the radioactive waste to be held therein is passed;

a manipulating ring mounted to said rim and extending in a radial direction therefrom, said manipulating ring including engaging means formed directly therein for facilitating engagement by a manipulating tool whereby said receptacle insert can be manipulated and placed in said vessel; and, centering means formed directly on said ring for contact engaging the inner wall surface of said vessel so as to cause said vessel and said insert to conjointly define a clear and unobstructed annular space between said inner wall surface of said vessel and the outer wall surface of said insert when the latter is lowered into and seated in said vessel;

said engaging means being a plurality of openings formed in said manipulating ring and communicating with said annular space so as to permit filling said space with a cast material after said insert is seated in said vessel; and, supporting means disposed on the wall of said receptacle insert beneath and in spaced relationship of said manipulating ring for coacting with the rim of a second receptacle insert when the inserts are stacked one on top of the other.

2. The transport and storage container assembly of claim 1, said manipulating ring being mounted to said rim so as to extend radially outwardly therefrom; said centering means being disposed at the outer periphery of said rim for coacting with said upper end portion of said vessel to center said insert in said vessel when said insert is placed therein;

said openings being segment-like openings and being disposed in spaced relationship one next to the other about the periphery of said manipulating ring;

said wall of said receptacle insert being inwardly tapered in the downward direction so as to have a conical configuration; and, said supporting means being a supporting ring projecting radially from said wall of said receptacle insert and having an outer diameter greater than the inner diameter of said manipulating ring.

3. The transport and storage container assembly of claim 2, said receptacle insert having a base and said wall of conical configuration extending upwardly from said base; said receptacle insert having a plurality of spacers mounted to the outer side of said base.

4. The transport and storage container assembly of claim 2, said manipulating ring being welded to said rim of said receptacle insert.

5. The transport and storage container assembly of claim 2, said manipulating ring having an outer surface facing said upper end portion of said vessel, said centering means being a downwardly inclined chamfer formed about the entire periphery of said manipulating ring.

6. The transport and storage container assembly of claim 1, said manipulating ring being a steel ring having a web and two legs conjointly defining a U-shaped cross-section, the legs of said steel ring being horizontal and directed inwardly toward the center of said ring.

7. The transport and storage container assembly of claim 6, said receptacle insert including a plurality of centering plates arranged about the respective outer peripheries of said manipulating ring and said rim, each of said centering plates being mounted to said rim and to said ring.

8. The transport and storage container assembly of claim 7, each of said centering plates extending outwardly away from the center of said ring and having a radial dimension which is only slightly less than the radial width of said annular gap.

9. The transport and storage container assembly of claim 8, said engaging means comprising a plurality of openings formed in said web of said steel ring, said openings being arranged in spaced relationship one to the other about the periphery of said ring, said openings being further arranged in said ring so as to be offset from said centering plates.

10. The transport and storage container assembly of claim 1, said supporting means being a bead-like projection extending outwardly from said wall of said receptacle insert.

11. The transport and storage container assembly of claim 1, said supporting means being a plurality of bead-like projections arranged in a common horizontal plane and projecting from said wall of said receptacle insert, said plurality of bead-like projections being in spaced relationship one to the other.

12. The transport and storage container assembly of claim 1, said receptacle insert having a base and said wall of conical configuration extending upwardly from said base; said receptacle insert having a guide tube mounted on said wall of conical configuration in the vicinity of said base; and, a plurality if spacers mounted on said guide tube in spaced relationship one with respect to the other.

13. A transport and storage container assembly for weak and medium radioactive waste comprising:

a cup-shaped receptacle insert for receiving the radioactive waste directly therein;

a vessel defining a longitudinal axis and having an opening at its upper end for receiving said receptacle insert therein when the latter is lowered into the same along said axis;

a cover for closing said opening of said vessel after said receptacle has been placed therein;

said receptacle insert having a rim at its upper end defining the opening thereof through which the radioactive waste to be held therein is passed;

said receptacle insert including a manipulating ring mounted to said rim and extending in a radial direction therefrom, said manipulating ring including engaging means formed therein for facilitating engagement by a manipulating tool whereby said receptacle insert can be manipulated and placed in said vessel; and, centering means formed directly on said ring for contact engaging the inner wall surface of said vessel so as to cause said vessel and said insert to conjointly define a clear and unobstructed annular space between said inner wall surface of said vessel and the outer wall surface of said insert when the latter is inserted and seated in said vessel;

said engaging means being a plurality of openings formed in said manipulating ring and communicating with said annular space so as to permit filling said space with a cast material after said insert is seated in said vessel;

said receptacle insert having supporting means on the wall thereof beneath said manipulating ring, said supporting means projecting radially from said receptacle insert wall so as to be in overlapping relationship with and in spaced relationship to said manipulating ring so as to permit storage stacking a plurality of empty ones of said receptacle inserts one inside the other with the supporting means of each one of the stacked inserts being in contact with the manipulating ring of the next insert disposed directly therebeneath; and, said wall of said receptacle insert being inwardly tapered in the downward direction so as to have a conical surface configuration whereby a jamming of said inserts is prevented when the latter are stacked.

14. Method of loading the container of a transport and storage container assembly for weak and medium radioactive waste, the container including a vessel and a cover and the assembly further including a receptacle insert for directly receiving the radioactive waste and which is adapted to fit into said vessel, the method being applicable to a shielded cell equipped with remotely-controlled manipulating means and having double-cover lock means arranged in the floor wall of the cell for separating the interior of the cell from the ambient and for detachably holding the cover of the container, the method comprising:

providing a stack of said receptacle inserts in said shielded cell;

taking the top receptacle insert from said stack utilizing said remotely-controlled manipulating means and bringing the same to a filling location;

filling said receptacle insert with radioactive waste;

bringing the filled receptacle insert to a position above said double-cover lock means;

connecting said vessel to said double-cover lock means at the lower side thereof in the ambient and beneath said floor wall;

opening said double-cover lock means;

lowering said receptacle insert through said double-cover lock means into said vessel;

removing said manipulating means and then closing said double-cover lock means; and, closing said vessel with said cover mounted in said double-cover lock means.

* * * * *

UNITED STATES PATENT AND TRADEMARK OFFICE

CERTIFICATE OF CORRECTION

PATENT NO. : 4,599,518

DATED : July 8, 1986

INVENTOR(S) : Werner Schmidt and Bernd D. Halm

It is certified that error appears in the above-identified patent and that said Letters Patent is hereby corrected as shown below:

In column 6, line 7: delete "of" and substitute -- to -- therefor.

In column 7, line 15: delete "if" and substitute -- of -- therefor.

Signed and Sealed this

*Twenty-third* Day of *September 1986*

[SEAL]

*Attest:*

DONALD J. QUIGG

*Attesting Officer* *Commissioner of Patents and Trademarks*